US008771589B2

(12) United States Patent
Menk et al.

(10) Patent No.: US 8,771,589 B2
(45) Date of Patent: Jul. 8, 2014

(54) SPHEROIDAL CAST IRON ALLOY PARTS AND METHOD FOR PRODUCING THEREOF

(75) Inventors: Werner Menk, Schaffhausen (CH); Rolf Rietzscher, Mettmann (DE); Andreas Hecker, Aach (DE); Torsten Rieck, Ratingen (DE)

(73) Assignee: Georg Fischer GmbH, Mettmann (DE)

( * ) Notice: Subject to any disclaimer, the term of this patent is extended or adjusted under 35 U.S.C. 154(b) by 159 days.

(21) Appl. No.: 11/577,327

(22) PCT Filed: Nov. 14, 2005

(86) PCT No.: PCT/EP2005/012160

§ 371 (c)(1),
(2), (4) Date: Apr. 16, 2007

(87) PCT Pub. No.: WO2006/056334

PCT Pub. Date: Jun. 1, 2006

(65) Prior Publication Data

US 2009/0047164 A1 Feb. 19, 2009

(30) Foreign Application Priority Data

Nov. 22, 2004 (DE) ..... 10 2004 056 331

(51) Int. Cl.
*C22C 37/04* (2006.01)
*C22C 37/06* (2006.01)
*C22C 37/10* (2006.01)

(52) U.S. Cl.
USPC ..... 420/14; 420/15; 420/18; 420/26; 148/321; 148/543

(58) Field of Classification Search
CPC ..... C22C 37/04; C22C 37/06; C22C 37/10
USPC ..... 148/321–324; 420/13–33
See application file for complete search history.

(56) References Cited

U.S. PATENT DOCUMENTS 6,866,726 B1 3/2005 Suzuki et al.
7,070,666 B2 7/2006 Druschitz et al.

(Continued)

FOREIGN PATENT DOCUMENTS

EP 0 525 540 2/1993
GB 832666 4/1960

(Continued)

OTHER PUBLICATIONS

English translation of Soviet Union patent 524852, Nov. 19,1976.*

(Continued)

*Primary Examiner* — Deborah Yee
(74) *Attorney, Agent, or Firm* — Bachman & LaPointe, P.C.

(57) ABSTRACT

A spheriodal cast alloy for producing cast iron products with great mechanical strength, high-wear resistance and a high degree of ductility. The alloy comprises the following as non-iron components: between 2.5 and 2.8 wt. % C, between 2.4 and 3.4 wt. % Si, between 0.02 and 0.08 wt. % P, between 0.02 and 0.06 wt. % Mg, between 0.01 and 0.05 wt. % Cr, between 0.002 and 0.02 wt. % Al, between 0.0005 and 0.015 wt. % S, between 0.0002 and 0.002 wt. % B and conventional impurities. The alloy contains between 3.0 and 3.7 wt. % C, between 2.6 and 3.4 wt. % Si, between 0.02 and 0.05 wt. % P, between 0.025 and 0.045 wt. % Mg, between 0.01 and 0.03 wt. % Cr, between 0.003 and 0.017 wt. % Al, between 0.0005 and 0.012 wt. % S and between 0.0004 and 0.002 wt. % B. The alloy is used for example to produce chassis parts or brake discs in the automobile industry.

6 Claims, 4 Drawing Sheets

(56) References Cited

U.S. PATENT DOCUMENTS

| | | | | |
|---|---|---|---|---|
| 7,156,929 | B2 | 1/2007 | Menk | |
| 2002/0000705 | A1 * | 1/2002 | Tunzini | 280/124.134 |
| 2002/0195180 | A1 | 12/2002 | Menk et al. | |

FOREIGN PATENT DOCUMENTS

| | | | |
|---|---|---|---|
| GB | 2190333 | * | 11/1987 |
| JP | 54-41216 | | 4/1979 |
| JP | 357054246 | * | 3/1982 |
| JP | 60-36755 | * | 2/1985 |
| JP | 60247036 | * | 12/1985 |
| JP | 9-111394 | | 4/1997 |
| JP | 409111394 | * | 4/1997 |
| SU | 524852 | * | 11/1976 |
| SU | 1528808 | * | 12/1989 |
| SU | 1749294 | * | 7/1992 |

OTHER PUBLICATIONS

English translation of Soviet Union patent 1528808, Dec. 15, 1989.*

English-hand translation of Japanese patent 60-36755, Fukuda et al., Feb. 25, 1985.*

Introduction to Steels and Cast Irons, Table 1.1 Essential and incidental elements in steel and cast iron, ASM, 1998.*

G.M. Goodrich, Introduction to Cast Irons, Casting, vol. 15, ASM Handbook, ASM International, 2008, pp. 7-8, http://products.asminternational.org.*

* cited by examiner

SPHEROIDAL CAST IRON ALLOY PARTS AND METHOD FOR PRODUCING THEREOF

BACKGROUND OF THE INVENTION

The invention relates to a spheroidal cast alloy for cast iron products with great mechanical strength, high wear resistance and at the same time a high degree of ductility, comprising as non-iron constituents 2.5 to 3.8% by weight C, 2.4 to 3.4% by weight Si, 0.02 to 0.08% by weight P, 0.02 to 0.06% by weight Mg, 0.01 to 0.05% by weight Cr, 0.002 to 0.02% by weight Al, 0.0005 to 0.015% by weight S, 0.0002 to 0.002% by weight B and the conventional impurities.

In motor vehicle construction, cast iron alloys are used for producing cast parts that must have high wear resistance, for example brake disks, which during the braking operation have to convert the kinetic energy of the vehicle into thermal energy. The brake disks can in this case reach temperatures of up to about 850° C. During the braking operation, not only the brake linings but also the brake disks are worn. Brake disks have irregular wear and often have to be replaced while still under warranty, involving high costs for the automobile manufacturer. In order that the wear on the surface of the brake disk takes place as evenly as possible, high demands are made of the crystalline structure and the homogeneity of the structure. The homogeneity can be improved by a suitable casting process.

GB 832 666 discloses a cast iron alloy comprising as non-iron constituents 1.0 to 2.5% by weight C, 1.5 to 3.2% by weight Si, less than 1.15% by weight Mn, less than 0.5% by weight S and 0.001 to 0.05% by weight B. After casting, the graphite component takes on the compact form. Because the alloy does not contain any Mg there is no spheroidal graphite or vermicular graphite present, but rather a graphite formation that resembles temper carbon nodes of malleable cast iron predominates. The alloy contains 5 to 10% carbides in a predominantly pearlitic matrix, which has the consequence that the elongation at rupture becomes relatively low. In order to limit the formation of lamellar graphite, and consequently improve the modulus of elasticity, tellurium and bismuth are admixed as alloying elements. Higher elongation at rupture values are achieved by a subsequent heat treatment.

US 2004/0112479-A1 discloses a further cast iron alloy, which preferably contains 3.7% by weight C, 2.5% by weight Si, 1.85% by weight Ni, 0.85% by weight Cu and 0.05% by weight Mo. This material is distinguished by an elongation of 20 to 16% with a tensile strength of 500 to 900 MPa and by a Brinell hardness of 180 to 290 HB. These properties are achieved after a time-consuming heat treatment, which comprises the following successive steps: 10 to 360 minutes of austenitizing at temperatures between 750 and 790° C., rapid cooling in a salt bath at a temperature between 300 and 400° C., 1 to 3 hours of austempering at temperatures between 300 and 400° C. and cooling to room temperature. After this treatment, the material has a structure with an austenitic and ferritic microstructure. The material is distinguished by easier machinability than a cast iron that has been subjected to a conventional type of austempering.

On the basis of this prior art, the object of the invention is to provide a cast iron alloy which is produced from elements that are as inexpensive as possible, the cast parts having the highest or greatest possible heat resistance and strength, in particular wear resistance, and at the same time a very high degree of ductility, without an additional heat treatment.

SUMMARY OF THE INVENTION

The object is achieved by a spheroidal cast alloy for cast iron products with great mechanical strength, high wear resistance and at the same time a high degree of ductility, comprising as non-iron constituents 2.5 to 3.8% by weight C, 2.4 to 3.4% by weight Si, 0.02 to 0.08% by weight P, 0.02 to 0.06% by weight Mg, 0.01 to 0.05% by weight Cr, 0.002 to 0.02% by weight Al, 0.0005 to 0.015% by weight S, 0.0002 to 0.002% by weight B and the conventional impurities, the alloy containing 3.0 to 3.7% by weight C, 2.6 to 3.4% by weight Si, 0.02 to 0.05% by weight P, 0.025 to 0.045% by weight Mg, 0.01 to 0.03% by weight Cr, 0.003 to 0.017% by weight Al, 0.0005 to 0.012% by weight S and 0.0004 to 0.002% by weight B.

DETAILED DESCRIPTION

Figure 1:
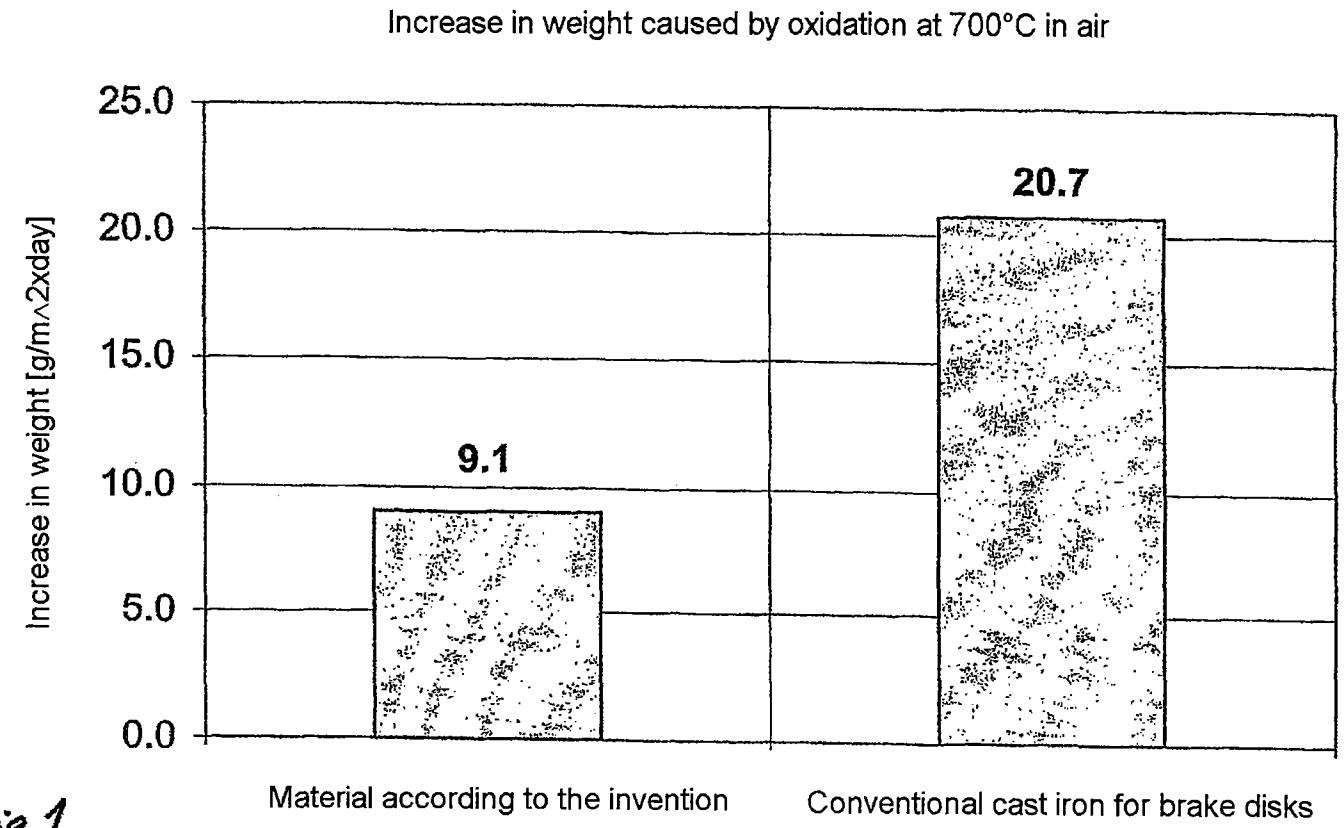
FIG. 1 compares weight increase due to oxidation of the material of the present invention compared to prior art material.

It is of advantage that the alloy has the best possible strength-strain behavior. This is achieved by the spheroidal cast alloy containing 0.1 to 1.5% by weight Cu, preferably 0.5 to 0.8% by weight Cu. This is also achieved by the alloy containing 0.1 to 1.0% by weight Mn, preferably 0.15 to 0.2% by weight Mn.

It is also of advantage that the alloy has the best possible wear behavior. This is achieved by the alloy containing 0.1 to 1.5% by weight Cu, preferably 0.5 to 0.8% by weight Cu and 0.1 to 1.0% by weight Mn, preferably 0.15 to 0.2% by weight Mn. This is also achieved by the alloy containing 0.1 to 1.5% by weight Mn, preferably 0.5 to 1.0% by weight Mn, and 0.05 to 1.0% by weight Cu, preferably 0.05 to 0.2% by weight Cu.

The essential idea of the invention is to provide a cast iron alloy which has a Brinell hardness of over 220 and which is worn as evenly as possible when used as a brake disk. The graphite in the cast iron alloy may be of a spheroidal or vermicular, but not lamellar form. Although brake disks with lamellar graphite are inexpensive, they have lower resistance to temperature changes. As a result, so-called fire cracks can already occur after a short time in use, rapidly growing and leading to irregularities of the surface. An irregular surface in turn leads to irregular thermal loading, irregular wear and so-called brake juddering.

Further applications of the spheroidal cast alloy according to the invention are axle and chassis parts for trucks and for passenger cars, such as for example wishbones, wheel carriers and pivot bearings, which are exposed to high mechanical and dynamic loads and in the case of a collision of the motor vehicle must plastically deform and must not rupture.

Example 1

A brake disk was produced from the spheroidal cast alloy according to the invention. The chemical composition was 3.34% by weight C, 2.92% by weight Si, 0.62% by weight Cu, 0.17% by weight Mn, 0.038% by weight Mg, 0.025% by weight P, 0.021% by weight Cr, 0.01% by weight Al, 0.001% by weight S and 0.0008% by weight B, the remainder Fe and the conventional impurities. The brake disk was investigated for the number of spherulites, graphite content, graphite form and graphite size, pearlite content and Brinell hardness. Specimens from the brake disk were subjected to a tensile test in order to establish the strength-strain behavior. The number of spherulites is 384+/−76 spherulites per $mm^2$. The graphite content is 9.7+/−0.7%. The graphite form in accordance with DIN EN ISO 945 is 97.9% of the form VI. The size distribution in accordance with DIN EN ISO 945 is 45% of size 8, 42% of size 7 and 13% of size 6. The pearlite content is 84+/−1%. The Brinell hardness is 248+/−3 HB. In the tensile test, the following values were established: yield strength $R_p0.2$=474 MPa, tensile strength Rm=778 MPa, elongation at rupture A5=11.4% and modulus of elasticity E=165 to 170 $kN/mm^2$.

Figure 2:
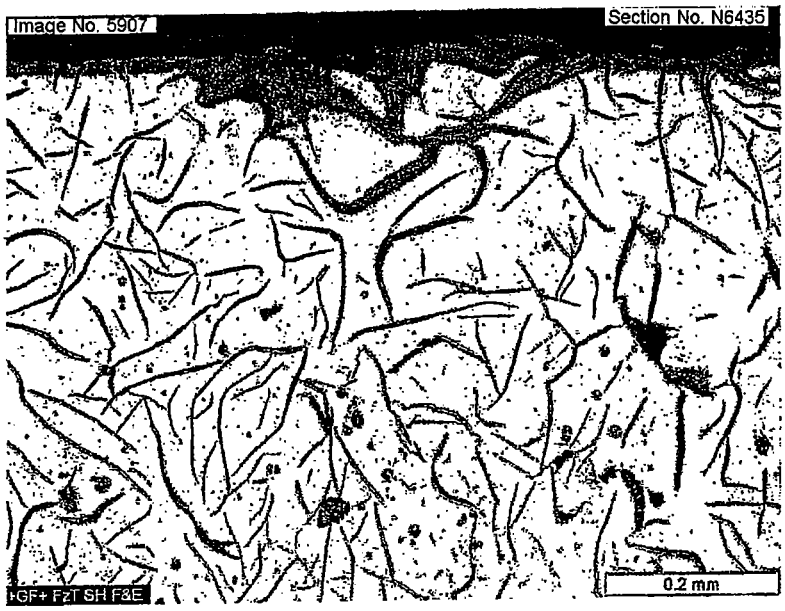
FIGS. 2 and 3 are photomicrographs of prior art material and material of the present invention, respectively.
Figure 3:
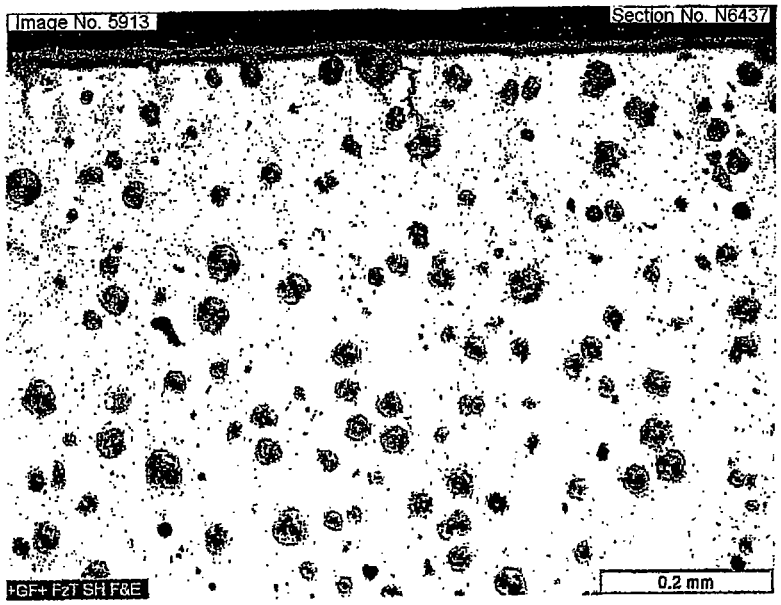

In comparison with the known materials for brake disks, it was possible to establish a much better oxidation behavior (see FIG. 1) and a greatly reduced tendency to fire cracking (see FIGS. 2 and 3). The oxidation behavior, and consequently also the wear behavior, is greatly improved by the addition of a mixture of copper and/or manganese to the spheroidal cast alloy.

In FIG. 1, the weight increase in grams per square meter and per day caused by oxidation at 700° C. in air is represented. The material according to the invention shows a weight increase of about 9 $g/m^2$.d, in comparison with a cast iron material for conventional brake disks with a weight increase of about 21 $g/m^2$.d.

The tests to test for fire cracking were carried out as follows: a sample with the dimensions 40×20×7 mm is subjected to at least 100 cycles comprising 7 seconds of heating up to 700° C. and 6 seconds of quenching in water. Subsequently, transverse sections are produced and examined under a microscope and photographed.

FIG. 2 shows a microphoto of a commercially available brake disk with a fire crack 0.4 mm deep. FIG. 3 shows a further microphoto of the brake disk according to the invention, to the same magnification, with a fire crack 0.14 mm deep.

Example 2

A wishbone for passenger cars was produced from the spheroidal cast alloy according to the invention. The chemical composition was 3.5% by weight C, 2.85% by weight Si, 0.63% by weight Cu, 0.18% by weight Mn, 0.038% by weight Mg, 0.026% by weight P, 0.029% by weight Cr, 0.004% by weight Al, 0.001% by weight S and 0.0007% by weight B, the remainder Fe and the conventional impurities. In the tensile test, the following values were established: yield strength $R_p0.2$=465 MPa, tensile strength Rm=757 MPa, elongation at rupture A5=11.1% and modulus of elasticity E=165 to 170 $kN/mm^2$. The Brinell hardness is 258+/−3 HB.

Example 3

A wheel carrier for passenger cars was produced from the spheroidal cast alloy according to the invention. The chemical composition was 3.43% by weight C, 3.38% by weight Si, 0.71% by weight Cu, 0.2% by weight Mn, 0.037% by weight Mg, 0.047% by weight P, 0.043% by weight Cr, 0.012% by weight Al, 0.004% by weight S and 0.0008% by weight B, the remainder Fe and the conventional impurities. In the tensile test, the following values were established: yield strength $R_p0.2$=558 MPa, tensile strength Rm=862 MPa and elongation at rupture A5=6.1%. The Brinell hardness is 288 HB. The number of spherulites in the microstructure was determined as 455 spherulites per $mm^2$.

Figure 4:
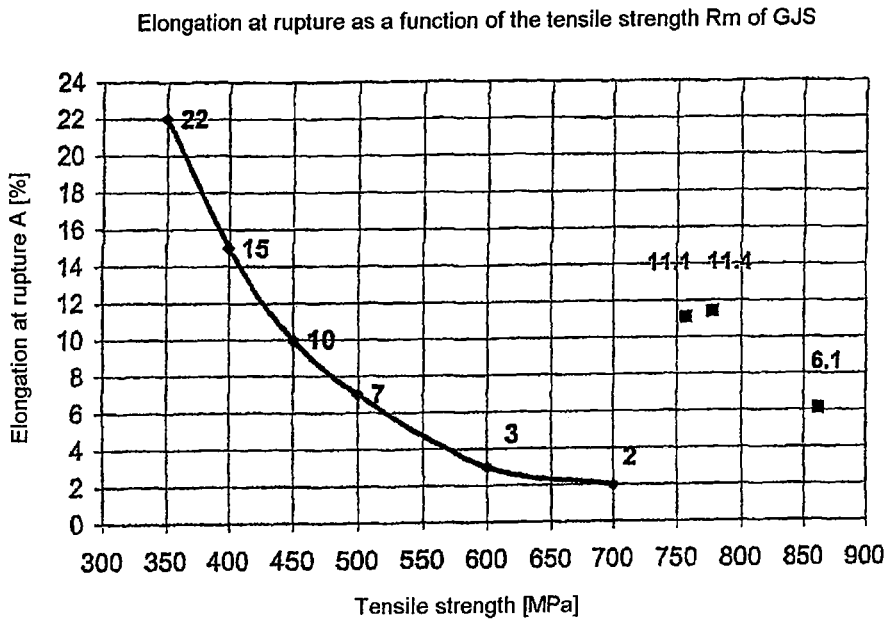
FIG. 4 shows the elongation at rupture A5 as a function of the tensile strength Rm.

FIG. 4 shows the elongation at rupture A5 as a function of the tensile strength Rm. The solid line indicates the minimum values in accordance with the standard EN 1563 for cast iron with spheroidal graphite of types produced in the cast state. The measurements of the material according to the invention are entered in accordance with Examples 1 to 3 presented above.

Figure 5:
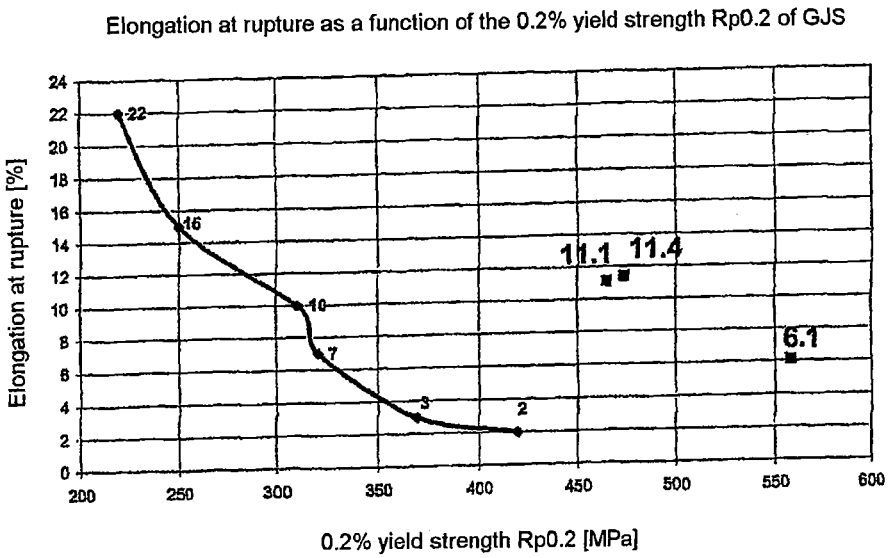
FIG. 5 shows the elongation at rupture A5 as a function of the yield strength $R_p0.2$.

FIG. 5 shows the elongation at rupture A5 as a function of the yield strength $R_p0.2$. The solid line indicates the minimum values in accordance with the standard EN 1563 for cast iron with spheroidal graphite of types produced in the cast state. The measurements of the material according to the invention are entered in accordance with Examples 1 to 3 presented above.

The material properties of the spheroidal cast iron according to the invention are consequently far above the European standard EN 1563 for cast iron with spheroidal graphite and even reach the values of ADI (=Austempered Ductile Iron), a cast iron material standardized in Europe under EN 1564 which is produced by a very complex heat treatment in relatively great wall thicknesses that can only be obtained by alloying the expensive elements nickel and/or molybdenum, and is consequently correspondingly expensive.

Figure 6:
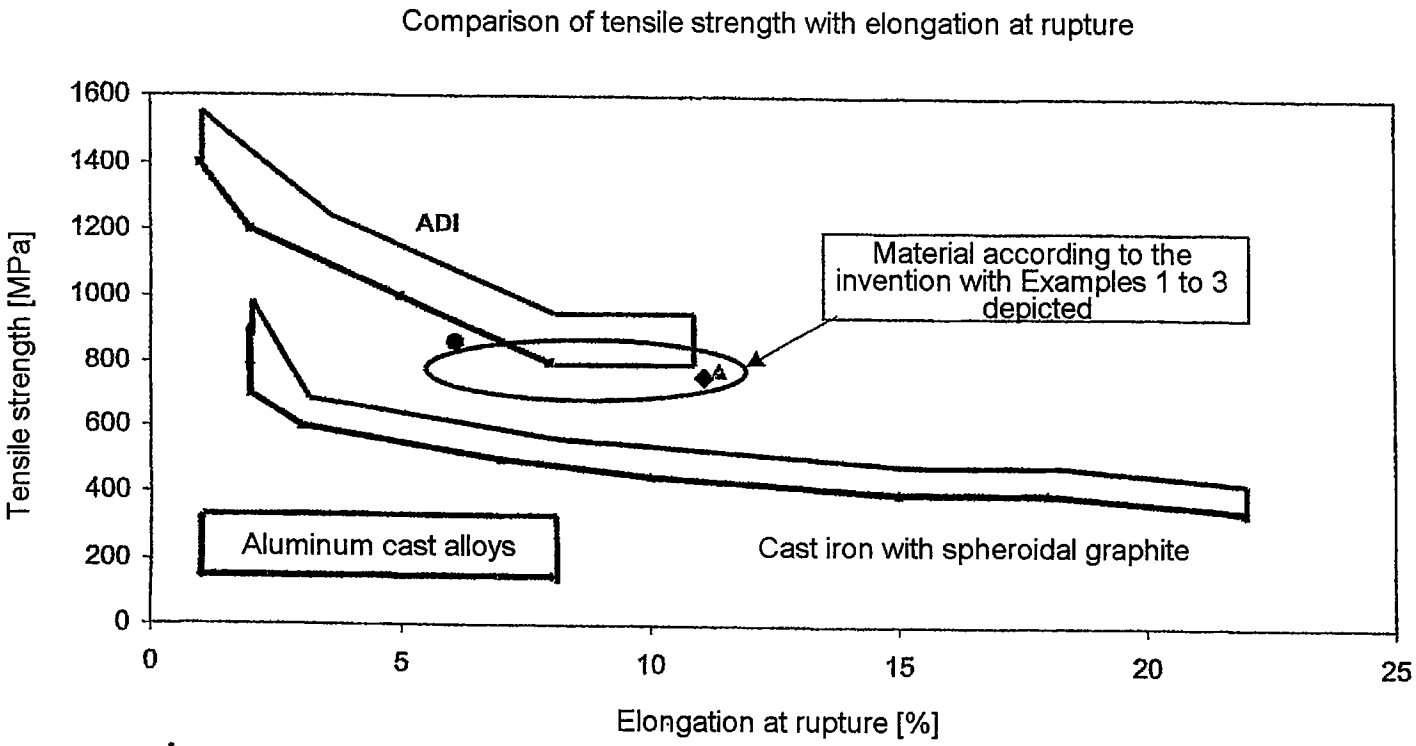
FIG. 6 shows the strength ranges against the elongation at rupture of the materials aluminum cast alloys, cast iron with spheroidal graphite, ADI and the material according to the invention.

FIG. 6 shows the strength ranges against the elongation at rupture of the materials aluminum cast alloys, cast iron with spheroidal graphite, ADI and the material according to the invention with Examples 1 to 3 entered.

The uniformity of the structure is also achieved by a novel casting process. The casting mold is divided horizontally instead of vertically, the brake disks being arranged horizontally and the filling of the casting mold being carried out from the middle toward the edge of the brake disk. This has the consequence that the casting mold is filled rotationally symmetrically and that the brake disk is uniformly cooled from the inside to the outside after casting. As a result, a uniform, homogeneous structure is created over the entire circumference of the brake disk. A subsequent heat treatment, which is time-consuming and incurs costs, is no longer required.

The invention claimed is:

1. A spheroidal cast iron alloy part having mechanical strength, high wear resistance and a high degree of ductility, consisting of:

3.43% by weight C,
3.38% by weight Si,
0.047% by weight P,
0.037% by weight Mg,
0.043% by weight Cr,
0.012% by weight Al,
0.004% by weight S,
0.71% by weight Cu,
0.2% by weight Mn,
0.0008% by weight B, and balance essentially Fe, wherein the cast part is selected from the group consisting of wheel carriers for motor vehicles, brake disks and wishbones for passenger cars, and wherein the cast part has an elongation at rupture A5 of 5 to 14% with a tensile strength Rm of 900 to 600 MPa in as cast and cooled condition.

2. The spheroidal cast iron alloy part as claimed in claim 1, wherein the crystalline structure of the cast part has 200 to 700 spherulites per $mm^2$ in as cast and cooled condition.

3. The spheroidal cast iron alloy part as claimed in claim 1, wherein the cast part has a Brinell hardness of over 220 in as cast and cooled condition.

4. The spheroidal cast iron alloy part as claimed in claim 1, wherein the cast part is a wheel carrier for motor vehicles.

5. The spheroidal cast iron alloy part as claimed in claim 1, wherein the cast part has a crystalline structure which is between 70 and 90% pearlitic in form.

6. A method for producing a cast part from a spheroidal cast iron alloy consisting of:

3.43% by weight C,
3.38% by weight Si,
0.047% by weight P,
0.037% by weight Mg,
0.043% by weight Cr,
0.012% by weight Al,
0.004% by weight S,
0.71% by weight Cu,
0.2% by weight Mn,
0.0008% by weight B, and balance essentially Fe, wherein the cast part is selected from the group consisting of wheel carriers for motor vehicles, brake disks and wishbones for passenger cars, and wherein the cast part has an elongation at rupture A5 of 5 to 14% with a tensile strength Rm of 900 to 600 MPa in as cast and cooled condition, comprising casting and cooling the cast part without intermediate and/or subsequent heat treatment of the cast part.

* * * * *